US006419791B1

(12) United States Patent
Dragner

(10) Patent No.: US 6,419,791 B1
(45) Date of Patent: Jul. 16, 2002

(54) AMINO ESTER THAT IMPARTS OPTICAL PROPERTIES WHEN ADDED TO PAPER

(75) Inventor: Louis Robert Dragner, Rock Hill, SC (US)

(73) Assignee: Omnova Solutions Inc., Fairlawn, OH (US)

( * ) Notice: Subject to any disclaimer, the term of this patent is extended or adjusted under 35 U.S.C. 154(b) by 20 days.

(21) Appl. No.: 09/592,104

(22) Filed: Jun. 12, 2000

(51) Int. Cl.[7] ..... D21H 17/06; D21H 17/07; D21H 21/14

(52) U.S. Cl. ..... 162/158; 162/179; 106/243; 106/287.24; 106/287.25; 106/287.26

(58) Field of Search ..... 162/179, 158; 106/243, 287.24, 287.25, 287.26

(56) References Cited

U.S. PATENT DOCUMENTS

| | | | |
|---|---|---|---|
| 2,381,575 | A | 8/1945 | DeGroote et al. |
| 5,264,082 | A | 11/1993 | Phan et al. |
| 5,292,363 | A | 3/1994 | Hutcheson |
| 5,293,363 | A | 3/1994 | Takeshita |
| 5,296,024 | A | 3/1994 | Hutcheson |
| 5,312,522 | A | 5/1994 | Van Phan et al. |
| 5,393,334 | A | 2/1995 | Hutcheson |
| 5,415,737 | A | 5/1995 | Phan et al. |
| 5,417,753 | A | 5/1995 | Hutcheson |
| 5,427,696 | A | 6/1995 | Phan et al. |
| 5,443,631 | A | 8/1995 | Brock et al. |
| 5,472,486 | A | 12/1995 | Dragner et al. |
| 5,478,387 | A | 12/1995 | Dragner et al. |
| 5,488,139 | A | 1/1996 | Dragner et al. |
| 5,492,600 | A | 2/1996 | Dragner et al. |
| 5,494,555 | A | 2/1996 | Dragner et al. |
| 5,498,315 | A | 3/1996 | Dragner et al. |
| 5,667,638 | A | 9/1997 | Dragner et al. |
| 5,705,663 | A | 1/1998 | Brock et al. |
| 5,716,498 | A | 2/1998 | Jenny et al. |
| 5,869,716 | A | 2/1999 | Pi Subirana et al. |

*Primary Examiner*—Peter Chin
(74) *Attorney, Agent, or Firm*—Robert F. Rywalski; Mary E. Golrick

(57) ABSTRACT

A novel method of opacifying paper, and a novel opacifier and opacifying composition which opacify as well as brighten paper, is provided. The novel opacifier comprises at least one diglyceride and at least one amino-ester compound. The opacifying composition comprises: solids and preferably water. The solids comprise opacifier and surfactant. Preferably, the opacifying composition is an emulsion of the solids in water.

47 Claims, No Drawings

AMINO ESTER THAT IMPARTS OPTICAL PROPERTIES WHEN ADDED TO PAPER

BACKGROUND OF THE INVENTION

In the paper making industry, opacity, brightness and strength of the paper are desirable traits which are often balanced against each other. Opacity, the degree which the paper transmits light is particularly desirable for many applications; papers with a low opacity are difficult to read when images are printed on both sides. Many conventional opacifiers add excessive bulk to the paper thereby increasing the weight and the thickness of the paper.

It would be desirable to have a bright, opaque paper which is not excessively bulky and does not suffer a decrease in strength.

SUMMARY OF THE INVENTION

The present invention provides a novel method of opacifying paper, and a novel opacifier and opacifying composition which opacify as well as brighten paper. The novel opacifier comprises a mixture of at least one diglyceride and at least one amino-ester compound. Preferably the opacifier comprises from 17% to 72%, more preferably from 31% to 63%, most preferably from 45% to 55% diglyceride and preferably from 28% to 83%, more preferably from 37% to 59%, most preferably from 45% to 55% of the amino-ester compound.

The opacifying composition comprises: preferably from 0.1% to 100%, more preferably from 0.1% to 35%, even more preferably from 1% to 25%, most preferably from 7% to 15% of solids and preferably from 0 to 99.9999%, more preferably from 0.0001% to 99.9999%, even more preferably from 65% to 99.9%, even more preferably from 99% to 75%, most preferably from 85% to 93% of liquid, preferably water.

The solids comprise opacifier and surfactant. Preferably the solids comprise from 50 to 100%, more preferably from 80% to 99.9999%, even more preferably from 95% to 99.9998%, most preferably from 97% to 99.9%, opacifier; and preferably from 0% to 50% more preferably from 0.0001% to 50%, even more preferably from 0.0001% to 20%, even more preferably from 0.0022% to 5%, most preferably from 0.1% to 3%, surfactant. Preferably, the opacifying composition is an emulsion of the solids in water.

The inventions also relate to paper, methods of enhancing optical properties of paper and to methods of making the novel opacifying compositions.

DETAILED DESCRIPTION OF THE INVENTION

The present invention provides a novel method of opacifying paper, and a novel opacifier and opacifying composition which opacify as well as brighten paper. The novel opacifier comprises a mixture of at least one diglyceride and at least one amino-ester compound. Preferably the opacifier comprises from 17% to 72%, more preferably from 31% to 63%, most preferably from 45% to 55% diglyceride and preferably from 28% to 83%, more preferably from 37% to 59%, most preferably from 45% to 55% of the amino-ester compound. The opacifying composition comprises the opacifier and preferably water.

The opacifying composition comprises: preferably from 0.1% to 100%, more preferably from 0.1% to 35%, even more preferably from 1% to 25%, most preferably from 7% to 15% of solids; and preferably from 0 to 99.9%, more preferably from 0.0001% to 99.9999%, even more preferably from 65% to 99.9%, even more preferably from 99% to 75%, most preferably from 85% to 93% of liquid, preferably water.

The solids comprise opacifier and surfactant. Preferably the solids comprise from 50% to 100%, more preferably from 80% to 99.9999%, even more preferably from 95% to 99.9998%, most preferably from 97% to 99.9%, opacifier; and preferably from 0% to 50%, more preferably from 0.0001% to 50%, even more preferably from 0.0001% to 20%, even more preferably from 0.0022% to 5%, most preferably from 0.1% to 3%, surfactant. All percentages are by weight unless otherwise stated.

Preferably, the opacifying composition is an emulsion of the solids in water.

An acid is preferably present in an effective amount to provide the opacifying composition with a pH less than 6. The acid is preferably present in an effective amount to provide the opacifying composition with a pH of from 3 to 6, more preferably 4 to 5.

The Opacifier

The opacifier comprises a mixture of at least one diglyceride and at least one amino-ester compound. The diglyceride has the following structure:

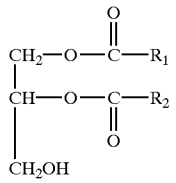

wherein:

$R_1$ is an alkyl group, preferably having from 4 to 23 carbon atoms, more preferably from 8 to 20 carbon atoms, most preferably from 10 to 17 carbon atoms;

$R_2$ is an alkyl group, preferably having from 4 to 23, more preferably from 8 to 20 carbon atoms, most preferably from 10 to 17 carbon atoms;

wherein $R_1$ and $R_2$ are the same or different.

Preferably the diglyceride is a mixture having from 10% to 95%, more preferably from 51% to 90% diglyceride wherein $R_1$ and $R_2$ have 17 carbon atoms, and from 5% to 90%, more preferably from 10% to 49%, diglyceride wherein $R_1$ and $R_2$ have 15 carbon atoms.

Good results have been obtained using hydrogenated tallow, which has a mixture of diglycerides, comprising for example: 3.4% of a diglyceride where $R_1$ and $R_2$ have 13 carbon atoms; 28.9% of a diglyceride where $R_1$ and $R_2$ have 15 carbon atoms; 0.8% of a diglyceride where $R_1$ and $R_2$ have 16 carbon atoms; and 66.9% of a diglyceride where $R_1$ and $R_2$ have 17 carbon atoms.

Good results have also been obtained using soybean oil, which has a mixture of diglycerides comprising for example: 0.1% of a diglyceride where $R_1$ and $R_2$ have 13 carbon atoms and no double bond; 0.1% of a diglyceride where $R_1$ and $R_2$ have 13 carbon atoms and one double bond; 10.5% of a diglyceride where $R_1$ and $R_2$ have 15 carbon atoms and no double bond; 3.2% of a diglyceride where $R_1$ and $R_2$ have 17 carbon atoms and no double bond; 22.3% of a diglyceride where $R_1$ and $R_2$ have 17 carbon atoms and one double bond; 54.5% of a diglyceride where $R_1$ and $R_2$ have 17 carbon atoms and two double bonds; 8.3% of a diglyceride where $R_1$ and $R_2$ have 17 carbon atoms and three double bonds; 0.2% of diglyceride where $R_1$ and $R_2$ have 19 carbon atoms and no double bond; 0.9% of a diglyceride where $R_1$ and $R_2$ have 19 carbon atoms and one double bond.

The amino-ester compound has the following structure:

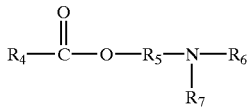

wherein:

$R_4$ is an alkyl group of from 4 to 23 carbon atoms, preferably from 10 to 17 carbon atoms;

$R_5$ is an alkyl alcohol group of from 1 to 15 carbon atoms, preferably from 1 to 6 carbon atoms;

$R_6$ is an alkyl group of from 1 to 15 carbon atoms, preferably from 1 to 6 carbon atoms, or an alkyl alcohol group of from 1 to 15 carbon atoms, preferably from 1 to 6 carbon atoms, or a hydrogen; and $R_7$ is an alkyl group of from 1 to 15 carbon atoms, preferably from 1 to 6 carbon atoms, or an alkyl alcohol group of from 1 to 15 carbon atoms, preferably from 1 to 6 carbon atoms, or a hydrogen;

wherein $R_5$, $R_6$, and $R_7$ are the same or different.

Good results have been obtained wherein $R_5$, $R_6$, and $R_7$ have two carbon atoms and $R_6$, and $R_7$ are alkyl alcohols.

Mixtures of diglycerides and mixtures of amino-ester compounds are also useful.

The Opacifying Composition

The opacifying composition comprises the opacifier, preferably a liquid the liquid preferably being water, preferably a surfactant, and preferably an acid. Preferably the surfactant is an ethylene oxide surfactant, preferably an ethoxylated tallow amine. Examples of other suitable surfactants are fatty acids ethoxylates, such as stearic acid with 20 moles of ethoxylate, fatty amine surfactants such as tallow amine with 15 moles ethoxylate, nonyl phenol ethoxylates, and fatty alcohol ethoxylates such as lauryl alcohol with 7 moles ethoxylate and stearyl alcohol with 24 moles of ethoxylate. Preferred acids are for example, acetic acid, propanoic acid, butanoic acid, pentanoic acid or methyl sulfate.

The salt is optionally added to reduce viscosity. Suitable salts are calcium chloride, sodium acetate and sodium bicarbonate. Preferably, the salt is present from 0.0022% to 1%, more preferably from 0.01% to 0.5%, most preferably from 0.1% to 0.3%.

Optionally, conventional antifoaming agents, bactericide, and fungicides are added to the opacifying composition or the opacifier or both.

Preparation of the Opacifying Composition

The opacifying composition is prepared by first combining a mixture comprising from 50% to 99%, preferably from 70% to 90%, more preferably from 76% to 86% by weight of at least one triglyceride, from 1% to 50%, preferably from 10% to 30%, more preferably from 13% to 23%, of an alkanolamine. Optionally a catalyst is present in an amount effective to catalyze the transesterification reaction. Preferably the catalyst is present from 0 to 5%, more preferably from 0.1% to 0.5%, more preferably from 0.075% to 0.15%.

The triglycerides are also known in the art as triacylglycerols. Sources for triglycerides are for example, tallow, soybean oil, castor oil, cottonseed oil, butter fat, and lard. The triglycerides have three alkyl groups each alkyl group having preferably from 4 to 23 carbon atoms. The triglyceride has the following structure:

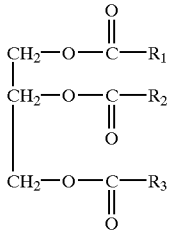

wherein:

$R_1$ is an alkyl group having from 4 to 23 carbon atoms, preferably 8 to 20 carbon atoms, more preferably 10 to 17 carbon atoms;

$R_2$ is an alkyl group having from 4 to 23, preferably 8 to 20 carbon atoms, more preferably 10 to 17 carbon atoms;

$R_3$ is an alkyl group having from 4 to 23, preferably 8 to 20 carbon atoms, more preferably 10 to 17 carbon atoms;

wherein $R_1$ $R_2$ and $R_3$ are the same or different.

The alkanolamine has the following structure:

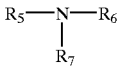

wherein:

$R_5$ is an alkyl alcohol group of from 1 to 15 carbon atoms, preferably from 1 to 6 carbon atoms;

$R_6$ is an alkyl alcohol group of from 1 to 15 carbon atoms, preferably from 1 to 6 carbon atoms;

$R_7$ is an alkyl alcohol group of from 1 to 15 carbon atoms, preferably from 1 to 6 carbon atoms or an alkyl group of from 1 to 15 carbon atoms, preferably from 1 to 6 carbon atoms, or a hydrogen; and wherein $R_4$, $R_5$ and $R_6$ are the same or different.

Suitable alkanolamines are for example, diethanolamine, N', N', dimethylethanolamine and triethanolamine. Mixtures of triglycerides and mixtures of alkanolamines are also useful.

The mixture is then reacted, preferably under heat, to form the opacifying composition. Good results have been obtained by heating at 180° C. to 200° C. for one to two hours. The emulsion is formed by adding the opacifying composition to water which contains an acid, and a surfactant, and heating with agitation. Good results have been obtained by heating to 93° C. for 30 minutes, then cooling to 70° C., adding the salt and then cooling to room temperature.

In the emulsion of the opacifying composition, the amino-ester compound is present as an amine salt. The opacifying composition preferably contains less than 20% triglycerides, less than 10% monoglycerides, less than 4% free alkanolamine and less than 6% free glycerin.

The opacifying composition is added to a pulp slurry also known in the art as a "furnish", which then is used to form the 5 paper. The pulp slurry is made using conventional techniques.

The opacifying composition is added from preferably 0.1 to 15 pounds/ton, preferably 0.5 to 12 pounds/ton, more preferably 1 to 10 pounds/ton, most preferably 2 to 4 pounds/ton of pulp slurry.

After the slurry is formed it is stored in holding tanks or fed into a papermaking machine. The opacifying composition is added to the pulp slurry after the pulp has been bleached but before the pulp enters the head box of the paper making machine. The opacifying composition may be added to the slurry when it is in the holding tank or may be added to the slurry as it moves along to the headbox of the papermaking machine.

The paper made from the pulp slurry containing the opacifying composition is also made using conventional techniques.

The Paper

As used herein, "paper" means a matted or felted sheet of fiber. Preferably the fiber is cellulosic. The paper of the present invention which is opacified with the opacifying composition comprises: fibers; at least one diglyceride; and at least one amino- ester compound. As used, herein "paper" means all types of sheets containing cellulosic fiber and includes but is not limited to, tissue, toweling, cardboard, newsprint, fine paper, lightweight coated paper, bible grade, phone book grade, super calendar grade, liner board, reply card grade, cylinder board, and filled sheets. The amount of opacifier present on the paper is preferably from 0.0001% to 10%; more preferably from 0.01% to 5%, most preferably from 0.05% to 2%.

EXAMPLE 1

An opacifying composition was prepared by charging a reaction vessel which was equipped with a stirrer, heating device and inert gas sparge, 81.7 g hydrogenated tallow, also known as hydrogentated tallow glycerides, from Chemol, Greensboro NC, 18.2 g triethanolamine and 0.1 g of sodium hydroxide. The mixture was heated to 180° C. and held for 95 minutes. The mixture was cooled and at 100° C. it was poured into a container. The opacifying composition was solid at room temperature, had an amine number of 23.0 and a softening point of 41° C. The opacifying composition was soluble in methanol.

The opacifying composition was emulsified adding 33 grams of the opacifying composition to 260 grams water containing 1 gram of tallow amine surfactant and 5 grams of 84% acetic acid solution. Next, the mixture was heated to 93° C. for 30 minutes. The emulsion was rapidly cooled, to 30° C. over 15–20 minutes. During the cooling period, 0.75 g of sodium acetate was added at 75° C.

The resulting emulsion was milky white 11% nonvolatile solids with a pH of 4.

EXAMPLE 2

An opacifying composition was prepared as in Example 1, except that soybean oil was used rather than hydrogenated tallow and the mixture was heated at 200° C. for three hours instead of 180° C. for 90 minutes. The opacifying composition was clear dark brown liquid at room temperature, had an amine value of 48.7 and a viscosity of Gardener Tube C. The opacifying composition was emulsified by adding 1 gram of tallow amine with 15 moles polyoxyethylene and 2 grams of acetic acid to 67 grams water, then adding to 30 grams of the opacifying composition. The resulting emulsion was milky white 11% nonvolatile solids with a pH of 4.

Evaluation

The opacifying compositions of Examples 1 and 2, in emulsified form were added to pulp slurry of acid soft wood pulp at various concentrations as shown in Table 1. First the pulp slurry as heated to between 130° F. to 150° F., and 363 pounds of the opacifying composition of the examples was added. The pulp slurry was held 15 to 30 minutes at 130° F., then two grams of pulp were added to a handsheet mold. The handsheet was pressed, dried and conditioned; that is the dried handsheet reaches equilibrium with the moisture in the surroundings. The resulting handsheet was then evaluated for brightness, opacity, scott bond, absorbency coefficient, scattering coefficient and water absorption. The printing opacity, the scattering power, scattering coefficient and absorption coefficient, are determined TAPPI Test Method T 425 om-96 (1996), "Opacity of Paper (15/d geometry, illuminant a/2, 89% reflectance backing and paper backing). Briefly, a hand sheet was placed into a Technibrite Micro TB-1C opacity and color measurement instrument, from Technidyne Company using the cup of the color measurement instrument for readings. Light scattering coefficient is the scattering power divided by the weight of sheet and is determined according to ISO/TAPPI procedure T 425 om-96 (1996). Basis weight is the mass in grams per $m^2$ and is determined according to ISO/TAPPI procedure T410 om-98, 1998.

Brightness, that is the reflectance of blue light having an effective wavelength of 457 nm and a spectral range of 400 to 500 nm is determined according to TAPPI Test Method "Brightness of pulp, Paper and Paperboard (directional reflectance at 457 nm)" T452-om-98 (1998). Brightness is determined by placing a hand sheet into a Technibrite Micro TB-1C opacity and color measurement instrument, from Technidyne Company.

Scott Bond method is determined according to TAPPI Test Method "Test for Interfiber Bond Using the Internal Bond Tester" T833 pm-94 provisional method 1994. The Scott bond was determined by using a Scott Internal Bond Tester from the Huygen Corp. The results are presented in Table 1.

TABLE 1

| Example | Brightness | Opacity | Scott bond | Absorb. Coeff. | Scat Coeff. | Water Absorb. |
|---|---|---|---|---|---|---|
| Wood Pulp Control | 66.7 | 86.3 | 128.7 | 1.78 | 48.3 | 75 |
| Ex. 1 | | | | | | |
| at 4 lb/ton wood pulp | 67.4 | 85.7 | 131.7 | 1.6 | 49.3 | 99 |
| at 7 pd/ton wood pulp | 68.3 | 87.2 | 122.3 | 1.8 | 51.5 | 135 |
| at 13 lb/ton wood pulp | 68.4 | 87.9 | 118.3 | 1.9 | 55.5 | 163 |
| Ex. 2 | | | | | | |
| at 4 lb/ton wood pulp | 67.8 | 85.6 | 131.7 | 1.7 | 49 | 55 |
| at 7 lb/ton wood pulp | 68.3 | 86.7 | 120.7 | 1.7 | 51.9 | 72 |
| at 13 lb/ton wood pulp | 67.7 | 86.8 | 111.7 | 1.9 | 53.2 | 77 |

The results show that the opacifying compositions significantly increase the optical properties of the paper with out a significant decrease in paper strength.

What is claimed is:

1. An opacifying composition comprising:

0% to 50% water; and

50% to 100% of solids, the solids comprising:

50% to 100% opacifier, the opacifier comprising:

from 17% to 72% by weight of the opacifier, of at least one diglyceride; and from 28% to 83%, by weight of the opacifier, of at least one amino-ester compound;

0 to 50% surfactant.

2. The opacifying composition comprising:

0% to 50% water; and

50% to 100% of solids, the solids comprising:

50% to 100% opacifier, the opacifier comprising:

from 17% to 72% by weight of the opacifier, of at least one diglyceride; and from 28% to 83%, by weight of the opacifier, of at least one amino-ester compound;

0 to 50% surfactant, wherein the diglyceride has the following structure:

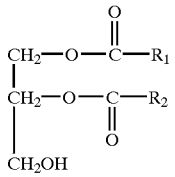

wherein $R_1$ is an alkyl group having from 4 to 23 carbon atoms;

$R_2$ is an alkyl group having from 4 to 23 carbon atoms; wherein $R_1$ and $R_2$ are the same or different; and the amino-ester compound has the following structure:

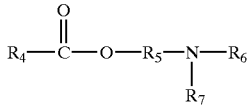

wherein:

$R_4$ is an alkyl group of from 4 to 23 carbon atoms;

$R_5$ is an alkyl alcohol group of from 1 to 15 carbon atoms;

$R_6$ is an alkyl group of from 1 to 15 carbon atoms, or an alkyl alcohol group of from 1 to 15 carbon atoms, or a hydrogen; and $R_7$ is an alkyl group of from 1 to 15 carbon atoms, or an alkyl alcohol group of from 1 to 15 carbon atoms, or a hydrogen;

wherein $R_5$, $R_6$, and $R_7$ are the same or different.

3. The opacifying composition of claim 2, wherein there is from 0.0001% to 50% by composition weight of water; and from 0.00001% to 50%, by solids weight, of the surfactant.

4. The opacifying composition of claim 3, wherein the surfactant comprises an ethylene oxide surfactant.

5. The opacifying composition of claim 3, wherein the diglyceride is present from 31% to 63% and $R_1$ is an alkyl group having from 8 to 20 carbon atoms and $R_2$ is an alkyl group having from 8 to 20 carbon atoms; the amino-ester compound is present from 37% to 59% and $R_4$ is an alkyl group of from 10 to 17 carbon atoms, $R_5$ is an alkyl group of from 1 to 6 carbon atoms, $R_6$ is an alkyl alcohol group of from 1 to 6 carbon atoms, and $R_7$ is an alkyl alcohol group of from 1 to 6 carbon atoms.

6. The opacifying composition of claim 3, wherein the diglyceride is present from 45% to 55% and $R_1$ is an alkyl group having from 10 to 17 carbon atoms and $R_2$ is an alkyl group having from 10 to 17 carbon atoms; the amino-ester compound is present from 45% to 55% and $R_4$ is an alkyl group of from 10 to 17 carbon atoms, $R_5$ is an alkyl group of 1 to 6 carbon atoms, $R_6$ is an alkyl alcohol group of 1 to 6 carbon atoms, and $R_7$ is an alkyl alcohol group of 1 to 6 carbon atoms.

7. The opacifying composition of claim 2, wherein the diglyceride is present from 45% to 55% and there is at least one diglyceride in which $R_1$ is an alkyl group having from 8 to 20 carbon atoms and $R_2$ is an alkyl group having from 8 to 20 carbon atoms; the amino-ester compound is present from 45% to 55% and there is at least one amino-ester compound in which $R_4$ is an alkyl group of from 10 to 17 carbon atoms, $R_5$ is an alkyl group of from 1 to 6 carbon atoms, $R_6$ is an alkyl alcohol group of from 1 to 6 carbon atoms, and $R_7$ is an alkyl alcohol group of 1 to 6 carbon atoms.

8. The opacifying composition of claim 7, wherein the diglyceride is present from 45% to 55%; the amino-ester compound is present from 45% to 55% the surfactant is an ethoxylated tallow amine which is present from 0.00001% to 50%, by solids weight, further wherein the opacifying composition is an emulsion.

9. The opacifying composition of claim 3, wherein there less than 20% triglycerides, less than 10% monoglycerides, less than 4% free alkanolamine and less than 6% free glycerin.

10. The opacifying composition of claim 3, wherein diglyceride is a mixture comprising from 10% to 95%, diglyceride wherein $R_1$ and $R_2$ have 17 carbon atoms, and from 5% to 90%, diglyceride wherein $R_1$ and $R_2$ have 15 carbon atoms.

11. The opacifying composition of claim 3, wherein the diglyceride is a mixture comprising from 51% to 90% wherein diglyceride wherein $R_1$ and $R_2$ have 17 carbon atoms, and from 10% to 49%, diglyceride wherein $R_1$ and $R_2$ have 15 carbon atoms.

12. The opacifying composition of claim 3, wherein the diglyceride is a mixture comprising from 55% to 98% of a diglyceride wherein $R_1$ and $R_2$ have 17 carbon atoms, and from 2% to 45% of a diglyceride wherein $R_1$ and $R_2$ have 15 carbon atoms.

13. The opacifying composition of claim 3, wherein the diglyceride is a mixture of diglycerides comprising: 3.4% of a diglyceride where $R_1$ and $R_2$ have 13 carbon atoms; 28.9% of a diglyceride where $R_1$ and $R_2$ have 15 carbon atoms; 0.8% of a diglyceride where $R_1$ and $R_2$ have 16 carbon atoms; and 66.9% of a diglyceride where $R_1$ and $R_2$ have 17 carbon atoms, and $R_5$, $R_6$, and $R_7$ of the aminoester have two carbon atoms and $R_6$, and $R_7$ are alkyl alcohols.

14. The opacifying composition of claim 3, wherein the diglyceride is a mixture of diglycerides comprising: a diglyceride where $R_1$ and $R_2$ have 13 carbon atoms and no double bond; a diglyceride where $R_1$ and $R_2$ have 13 carbon atoms and one double bond; a diglyceride where $R_1$ and $R_2$ have 15 carbon atoms and no double bond; a diglyceride where $R_1$ and $R_2$ have 17 carbon atoms and no double bond; a diglyceride where $R_1$ and $R_2$ have 17 carbon atoms and a double bond; a diglyceride where $R_1$ and $R_2$ have 17 carbon atoms and two double bonds; a diglyceride where $R_1$ and $R_2$ have 17 carbon atoms and three double bonds; a diglyceride where $R_1$ and $R_2$ have 19 carbon atoms and no double bond; a diglyceride where $R_1$ and $R_2$ have 19 carbon atoms and a double bond, and $R_5$, $R_6$, and $R_7$ of the aminoester have two carbon atoms and $R_6$, and $R_7$ are alkyl alcohols.

15. The opacifying composition of claim 12, further comprising from an effective amount of an acid to provide the opacifying composition with a pH of from 3 to 6; from 0.0001% to 20% surfactant; and from 0.0022% to 1% salt.

16. A method of opacifying paper comprising the following steps:

providing an opacifying composition containing the reaction products of at least one triglyceride and at least one alkanolamine;

combining said opacifying composition with a pulp slurry; and then forming a cellulosic sheet from the pulp slurry.

17. A method of opacifying paper comprising the following steps:

providing an opacifying composition containing the reaction products of at least one triglyceride and at least one alkanolamine;

combining said opacifying composition with a pulp slurry; and then forming a cellulosic sheet from the pulp slurry, wherein the triglyceride has the following structure structure:

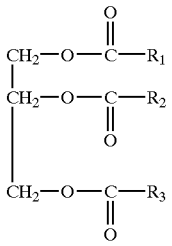

wherein $R_1$ is an alkyl group having from 4 to 23 carbon atoms;

$R_2$ is an alkyl group having from 4 to 23 carbon atoms;

$R_3$ is an alkyl group having from 4 to 23 carbon atoms;

wherein $R_1$ $R_2$ and $R_3$ are the same or different;

the alkanolamine has the following structure:

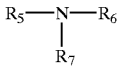

wherein:

$R_5$ is an alkyl alcohol group of from 1 to 15 carbon atoms, preferably from 1 to 6 carbon atoms;

$R_6$ is an alkyl alcohol group of from 1 to 15 carbon atoms, preferably from 1 to 6 carbon atoms;

$R_7$ is an alkyl alcohol group of from 1 to 15 carbon atoms, preferably from 1 to 6 carbon atoms or an alkyl group of from 1 to 15 carbon atoms, preferably from 1 to 6 carbon atoms, or a hydrogen; and wherein $R_5$, $R_6$, and $R_7$ are the same or different.

18. The method of claim 17, wherein the triglyceride is present in the reaction from 50% to 99% and $R_1$ is an alkyl group having from 8 to 20 carbon atoms, $R_2$ is an alkyl group having from 8 to 20 carbon atoms, $R_3$ is an alkyl group having from 8 to 20 carbon atoms; the alkanolamine is present in the reaction from 1% to 50% and $R_5$ is an alkyl alcohol group of from 1 to 15 carbon atoms, $R_6$ is an alkyl alcohol group of from 1 to 15 carbon atoms, and $R_7$ is an alkyl alcohol group of from 1 to 15 carbon atoms.

19. The method of claim 18, wherein the triglyceride is obtained from a source selected form the group consisting of:, tallow, soybean oil, castor oil, cottonseed oil, butter fat, lard and mixtures thereof; and the alkanolamine is selected from the group consisting of: diethanolamine, N', N', dimethylethanolamine and triethanolamine, and mixtures thereof.

20. The method of claim 16, wherein the triglyceride is present from 70% to 90% and $R_1$ is an alkyl group having from 10 to 14 carbon atoms and $R_2$ is an alkyl group having from 10 to 14 carbon atoms, $R_3$ is an alkyl group having from 8 to 20 carbon atoms; the alkanolamine is present from 10% to 30% and $R_5$ is an alkyl alcohol group of 2 carbon atoms, $R_6$ is an alkyl alcohol group of 2 carbon atoms, and $R_7$ is an alkyl alcohol group of 2 carbon atoms.

21. The method of claim 18, wherein the triglyceride is obtained from hydrogenated tallow and the alkanolamine is triethanolamine.

22. The method of claim 18, wherein the triglyceride is obtained from soybean oil and the alkanolamine is triethanolamine.

23. A method of opacifying paper comprising the following steps:

providing an opacifying composition comprising:

0% to 50% water; and

50% to 100% of solids, the solids comprising:

50% to 100% opacifier, the opacifier comprising:

from 17% to 72% of at least one diglyceride; and from 28% to 83% of at least one amino-ester compound;

combining the opacifying composition with a pulp slurry; and then forming paper from the pulp slurry.

24. Paper, comprising:

cellulose fibers; and an opacifier comprising:

at least one diglyceride; and at least one amino-ester compound.

25. The paper of claim 24, wherein the opacifier is present from 0.0001% to 10% by weight of the paper.

26. Paper, comprising:

0% to 50% water; and

50% to 100% of solids, the solids comprising:

50% to 100% opacifier, the opacifier comprising:

from 17% to 72% by weight of the opacifier, of at least one diglyceride; and from 28% to 83%, by weight of the opacifier, of at least one amino-ester compound;

0 to 50% surfactant, wherein the diglyceride has the following structure:

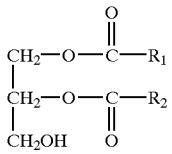

wherein $R_1$ is an alkyl group having from 4 to 23 carbon atoms;

$R_2$ is an alkyl group having from 4 to 23 carbon atoms; wherein $R_1$ and $R_2$ are the same or different; and the amino-ester compound has the following structure:

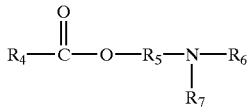

wherein:

$R_4$ is an alkyl group of from 4 to 23 carbon atoms;

$R_5$ is an alkyl alcohol group of from 1 to 15 carbon atoms;

$R_6$ is an alkyl group of from 1 to 15 carbon atoms, or an alkyl alcohol group of from 1 to 15 carbon atoms, or a hydrogen; and $R_7$ is an alkyl group of from 1 to 15 carbon atoms, or an alkyl alcohol group of from 1 to 15 carbon atoms, or a hydrogen;

wherein $R_5$, R6, and $R_7$ are the same or different.

27. The paper of claim 26, wherein the diglyceride is present from 31% to 63% and $R_1$ is an alkyl group having from 8 to 20 carbon atoms and $R_2$ is an alkyl group having from 8 to 20 carbon atoms; the amino-ester compound is present from 37% to 59% and $R_4$ is an alkyl group of from 10 to 17 carbon atoms, $R_5$ is an alkyl group of from 1 to 6 carbon atoms, $R_6$ is an alkyl alcohol group of from 1 to 6 carbon atoms, and $R_7$ is an alkyl alcohol group of from 1 to 6 carbon atoms.

28. The paper of claim 26, wherein the diglyceride is present from 45% to 55% and $R_1$ is an alkyl group having from 10 to 17 carbon atoms and $R_2$ is an alkyl group having from 10 to 17 carbon atoms; the amino-ester compound is present from 45% to 55% and $R_4$ is an alkyl group of from 10 to 17 carbon atoms, $R_5$ is an alkyl group of 1 to 6 carbon atoms, $R_6$ is an alkyl alcohol group of 1 to 6 carbon atoms, and R7 is an alkyl alcohol group of 1 to 6 carbon atoms.

29. The paper of claim 26, wherein the diglyceride is present from 45% to 55% and there is at least one diglyceride in which $R_1$ is an alkyl group having from 8 to 20 carbon atoms and $R_2$ is an alkyl group having from 8 to 20 carbon atoms; the amino-ester compound is present from 45% to 55% and there is at least one amino-ester compound in which $R_4$ is an alkyl group of from 10 to 17 carbon atoms, $R_5$ is an alkyl group of from 1 to 6 carbon atoms, $R_6$ is an alkyl alcohol group of from 1 to 6 carbon atoms, and $R_7$ is an alkyl alcohol group of 1 to 6 carbon atoms.

30. The paper of claim 26, wherein the diglyceride is present from 45% to 55%; the amino-ester compound is present from 45% to 55% the surfactant is an ethoxylated tallow amine which is present from 0.00001% to 50%, by solids weight, further wherein the opacifying composition is an emulsion.

31. The paper of claim 26, wherein there are less than 20% triglycerides, less than 10% monoglycerides, less than 4% free alkanolamine and less than 6% free glycerin.

32. The paper of claim 26, wherein diglyceride is a mixture comprising from 10% to 95%, diglyceride wherein $R_1$ and $R_2$ have 17 carbon atoms, and from 5% to 90%, diglyceride wherein $R_1$ and $R_2$ have 15 carbon atoms.

33. The paper of claim 26, wherein the diglyceride is a mixture comprising from 51% to 90% wherein diglyceride wherein $R_1$ and $R_2$ have 17 carbon atoms, and from 10% to 49%, diglyceride wherein $R_1$ and $R_2$ have 15 carbon atoms.

34. The paper of claim 26, wherein the diglyceride is a mixture comprising from 55% to 98% of a diglyceride wherein $R_1$ and $R_2$ have 17 carbon atoms, and from 2% to 45% of a diglyceride wherein $R_1$ and $R_2$ have 15 carbon atoms.

35. The paper of claim 26, wherein the diglyceride is a mixture of diglycerides comprising: 3.4% of a diglyceride where $R_1$ and $R_2$ have 13 carbon atoms; 28.9% of a diglyceride where $R_1$ and $R_2$ have 15 carbon atoms; 0.8% of a diglyceride where $R_1$ and $R_2$ have 16 carbon atoms; and 66.9% of a diglyceride where $R_1$ and $R_2$ have 17 carbon atoms, and $R_5$, $R_6$, and $R_7$ of the aminoester have two carbon atoms and $R_6$, and $R_7$ are alkyl alcohols.

36. The paper of claim 26, wherein the diglyceride is a mixture of diglycerides comprising: a diglyceride where $R_1$ and $R_2$ have 13 carbon atoms and no double bond; a diglyceride where $R_1$ and $R_2$ have 13 carbon atoms and one double bond; a diglyceride where $R_1$ and $R_2$ have 15 carbon atoms and no double bond; a diglyceride where $R_1$ and $R_2$ have 17 carbon atoms and no double bond; a diglyceride where $R_1$ and $R_2$ have 17 carbon atoms and a double bond; a diglyceride where $R_1$ and $R_2$ have 17 carbon atoms and two double bonds; a diglyceride where $R_1$ and $R_2$ have 17 carbon atoms and three double bonds; a diglyceride where $R_1$ and $R_2$ have 19 carbon atoms and no double bond; a diglyceride where $R_1$ and $R_2$ have 19 carbon atoms and a double bond, and $R_5$, $R_6$, and $R_7$ of the aminoester have two carbon atoms and $R_6$, and $R_7$ are alkyl alcohols.

37. A method of opacifying paper comprising the following steps:

providing an opacifying composition comprising:

0% to 50% water; and

50% to 100% of solids, the solids comprising:

50% to 100% opacifier, the opacifier comprising:

from 17% to 72% of at least one diglyceride; and from 28% to 83% of at least one amino-ester compound;

combining the opacifying composition with a pulp slurry; and then forming paper from the pulp slurry, wherein the diglyceride has the following structure:

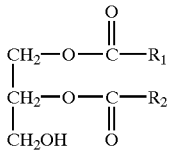

wherein $R_1$ is an alkyl group having from 4 to 23 carbon atoms;

$R_2$ is an alkyl group having from 4 to 23 carbon atoms; wherein $R_1$ and $R_2$ are the same or different; and the amino-ester compound has the following structure:

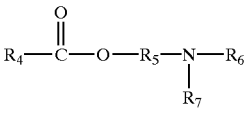

wherein:

$R_4$ is an alkyl group of from 4 to 23 carbon atoms;

$R_5$ is an alkyl alcohol group of from 1 to 15 carbon atoms;

$R_6$ is an alkyl group of from 1 to 15 carbon atoms, or an alkyl alcohol group of from 1 to 15 carbon atoms, or a hydrogen; and $R_7$ is an alkyl group of from 1 to 15 carbon atoms, or an alkyl alcohol group of from 1 to 15 carbon atoms, or a hydrogen;

wherein $R_5$, $R_6$, and $R_7$ are the same or different.

38. The paper of claim 37, wherein the diglyceride is present from 31% to 63% and R, is an alkyl group having from 8 to 20 carbon atoms and $R_2$ is an alkyl group having from 8 to 20 carbon atoms; the amino-ester compound is present from 37% to 59% and $R_4$ is an alkyl group of from 10 to 17 carbon atoms, $R_5$ is an alkyl group of from 1 to 6 carbon atoms, R6 is an alkyl alcohol group of from 1 to 6 carbon atoms, and $R_7$ is an alkyl alcohol group of from 1 to 6 carbon atoms.

39. The method of claim 37, wherein the diglyceride is present from 45% to 55% and $R_1$ is an alkyl group having from 10 to 17 carbon atoms and $R_2$ is an alkyl group having from 10 to 17 carbon atoms; the amino-ester compound is present from 45% to 55% and $R_4$ is an alkyl group of from 10 to 17 carbon atoms, $R_5$ is an alkyl group of 1 to 6 carbon atoms, $R_6$ is an alkyl alcohol group of 1 to 6 carbon atoms, and $R_7$ is an alkyl alcohol group of 1 to 6 carbon atoms.

40. The method of claim 37, wherein the diglyceride is present from 45% to 55% and there is at least one diglyceride in which R, is an alkyl group having from 8 to 20 carbon atoms and $R_2$ is an alkyl group having from 8 to 20 carbon atoms; the amino-ester compound is present from 45% to 55% and there is at least one amino-ester compound in which $R_4$ is an alkyl group of from 10 to 17 carbon atoms, $R_5$ is an alkyl group of from 1 to 6 carbon atoms, $R_6$ is an alkyl alcohol group of from 1 to 6 carbon atoms, and $R_7$ is an alkyl alcohol g group of 1 to 6 carbon atoms.

41. The method of claim 37, wherein the diglyceride is present from 45% to 55%; the amino-ester compound is present from 45% to 55% the surfactant is an ethoxylated tallow amine which is present from 0.00001% to 50%, by solids weight, further wherein the opacifying composition is an emulsion.

42. The method of claim 37, wherein there are less than 20% triglycerides, less than 10% monoglycerides, less than 4% free alkanolamine and less than 6% free glycerin.

43. The method of claim 37, wherein diglyceride is a mixture comprising from 10% to 95%, diglyceride wherein R, and $R_2$ have 17 carbon atoms, and from 5% to 90%, diglyceride wherein $R_1$ and $R_2$ have 15 carbon atoms.

44. The method of claim 37, wherein the diglyceride is a mixture comprising from 51% to 90% wherein diglyceride wherein $R_1$ and $R_2$ have 17 carbon atoms, and from 10% to 49%, diglyceride wherein $R_1$ and $R_2$ have 15 carbon atoms.

45. The method of claim 37, wherein the diglyceride is a mixture comprising from 55% to 98% of a diglyceride wherein $R_1$ and $R_2$ have 17 carbon atoms, and from 2% to 45% of a diglyceride wherein $R_1$ and $R_2$ have 15 carbon atoms.

46. The method of claim 37, wherein the diglyceride is a mixture of diglycerides comprising: 3.4% of a diglyceride where $R_1$ and $R_2$ have 13 carbon atoms; 28.9% of a diglyceride where $R_1$ and $R_2$ have 15 carbon atoms; 0.8% of a diglyceride where $R_1$ and $R_2$ have 16 carbon atoms; and 66.9% of a diglyceride where $R_1$ and $R_2$ have 17 carbon atoms, and $R_5$, $R_6$, and $R_7$ of the aminoester have two carbon atoms and $R_6$, and R7 are alkyl alcohols.

47. The method of claim 37, wherein the diglyceride is a mixture of diglycerides comprising: a diglyceride where $R_1$ and $R_2$ have 13 carbon atoms and no double bond; a diglyceride where $R_1$ and $R_2$ have 13 carbon atoms and one double bond; a diglyceride where $R_1$ and $R_2$ have 15 carbon atoms and no double bond; a diglyceride where $R_1$ and $R_2$ have 17 carbon atoms and no double bond; a diglyceride where $R_1$ and $R_2$ have 17 carbon atoms and a double bond; a diglyceride where $R_1$ and $R_2$ have 17 carbon atoms and two double bonds; a diglyceride where $R_1$ and $R_2$ have 17 carbon atoms and three double bondss; a diglyceride where $R_1$ and $R_2$ have 19 carbon atoms and no double bond; a diglyceride where $R_1$ and $R_2$ have 19 carbon atoms and a double bond, and $R_5$, $R_6$, and $R_7$ of the aminoester have two carbon atoms and $R_6$, and $R_7$ are alkyl alcohols.

* * * * *